US010612370B2

(12) United States Patent
Bouldin et al.

(10) Patent No.: US 10,612,370 B2
(45) Date of Patent: Apr. 7, 2020

(54) OPEN SMART COMPLETION

(71) Applicant: Saudi Arabian Oil Company, Dhahran (SA)

(72) Inventors: Brett W. Bouldin, Dhahran (SA); Robert John Turner, Dhahran (SA); Jonathan W. Brown, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/666,179

(22) Filed: Aug. 1, 2017

(65) Prior Publication Data

US 2019/0040736 A1 Feb. 7, 2019

(51) Int. Cl.

| | |
|---|---|
| ***G01V 3/00*** | (2006.01) |
| ***E21B 47/12*** | (2012.01) |
| ***E21B 47/00*** | (2012.01) |
| ***E21B 43/12*** | (2006.01) |
| ***E21B 34/14*** | (2006.01) |
| ***E21B 43/02*** | (2006.01) |
| ***E21B 23/00*** | (2006.01) |

(52) U.S. Cl.

CPC ..... *E21B 47/121* (2013.01); *E21B 23/00* (2013.01); *E21B 34/14* (2013.01); *E21B 43/02* (2013.01); *E21B 43/12* (2013.01); *E21B 47/00* (2013.01)

(58) Field of Classification Search

CPC ..... E21B 47/121; E21B 23/00; E21B 34/14; E21B 43/02; E21B 43/12; E21B 47/00

USPC ..... 340/854.5

See application file for complete search history.

(56) References Cited

U.S. PATENT DOCUMENTS

| | | | | |
|---|---|---|---|---|
| 6,046,685 | A * | 4/2000 | Tubel | E21B 23/03 137/606 |
| 6,464,004 | B1 * | 10/2002 | Crawford | E21B 17/028 166/250.01 |
| 6,679,332 | B2 | 1/2004 | Vinegar et al. | |
| 7,079,952 | B2 | 7/2006 | Thomas et al. | |
| 7,478,024 | B2 | 1/2009 | Gurpinar et al. | |
| 9,528,861 | B1 * | 12/2016 | Haupt | G01D 7/00 |

(Continued)

FOREIGN PATENT DOCUMENTS

| | | | |
|---|---|---|---|
| GB | 2309471 | A | 7/1997 |
| WO | 2009143409 | A2 | 11/2009 |
| WO | 2014011148 | A1 | 1/2014 |

OTHER PUBLICATIONS

Ross, D., et al. "Connect Pores, Processes, Profits"—Management Report. E&P, Apr. 2007, 2 pages.

(Continued)

*Primary Examiner* — Zhen Y Wu

(74) *Attorney, Agent, or Firm* — Bracewell LLP; Constance G. Rhebergen; Linda L. Morgan

(57) ABSTRACT

A system for subterranean well developments includes a downhole assembly having well completion components for permanent installation within the subterranean well and interchangeable retrievable hardware. A connection system adapts the retrievable hardware to the well completion components, the connection system operable to provide a connection between the well completion components and the retrievable hardware. A telemetry system is in communication with the retrievable hardware and operable to access data from the downhole assembly. A remote access interface is in communication with the retrievable hardware.

23 Claims, 3 Drawing Sheets

(56) References Cited

U.S. PATENT DOCUMENTS

2003/0098799 A1* 5/2003 Zimmerman ..... G01V 11/002 340/854.6
2003/0234110 A1 12/2003 McGregor
2005/0056415 A1 3/2005 Zillinger
2011/0017468 A1* 1/2011 Birch ..... E21B 17/026 166/369
2012/0067567 A1* 3/2012 Rytlewski ..... E21B 41/0085 166/250.01
2012/0305241 A1* 12/2012 Rytlewski ..... G21H 1/02 166/250.01
2013/0124176 A1* 5/2013 Fox ..... G06F 17/00 703/7
2013/0341044 A1* 12/2013 Flusche ..... E21B 7/023 166/381
2014/0083688 A1* 3/2014 Rojas ..... E21B 44/00 166/250.01
2014/0253341 A1* 9/2014 Harris ..... E21B 47/122 340/854.6
2015/0007982 A1* 1/2015 Zweifel ..... E21B 47/182 166/250.01
2015/0292321 A1* 10/2015 Keller ..... E21B 47/12 367/81
2016/0290099 A1* 10/2016 Balasubramanian ... F03G 7/065
2016/0335409 A1* 11/2016 Mensinger ..... A61B 5/7445
2018/0171777 A1* 6/2018 Cooley ..... H02J 7/0042
2019/0186236 A1* 6/2019 Asthana ..... E21B 34/066

OTHER PUBLICATIONS

Emerson, "Intelligent Fields" Supplement to E&P Magazine; Emerson Process Management. Sep. 2010, 24 pages.

The Halliburton Company Catalog: Intelligent Completions, pp. 3.1-3.54; http://www.halliburton.com/public/cps/contents/Books_and_Catalogs/web/CPSCatalog/03_Intelligent_Completions.pdf.

The International Search Report and Written Opinion for related PCT application PCT/US2018/044723 dated Oct. 25, 2018.

Silva et al., "Review, Analysis and Comparison of Intelligent Well Monitoring Systems", SPE Intelligent Energy International held in Utrecht, the Netherlands, 2012, pp. 1-20, Society of Petroleum Engineers.

* cited by examiner

OPEN SMART COMPLETION

BACKGROUND

1. Field of the Disclosure

The present disclosure relates in general to intelligent completions of subterranean wells, and more particularly to intelligent completions with accessible communications and interchangeable retrievable hardware.

2. Description of the Related Art

The market penetration of intelligent completions, also known as smart well technology, is very low due to the high costs of the hardware, reliability issues, complexity risks and development costs due to the long duration of engineering and testing. Currently available intelligent completions are generally sourced and developed through a single supplier. This limits completion design options and slows technology developments.

In addition, the communication from downhole sensors and actuators to the user is complicated with regards to operator information technology policies and access for third parties. This creates an inflexible barrier for developing and deploying new technology due to the costs of long term new product development. The service companies that provide the completion equipment have their own culture and methods with regards to completion architecture and technology and as a result completion equipment is not usually compatible between companies, which exacerbates the inflexible barrier. In currently available systems, the internal communications system, control panel, downhole completion, sensors and actuators, and other downhole hardware is all part of a closed architecture inaccessible system with private proprietary mechanical and communications systems. A close collaborative relationship exists between the service company and the operator to work on a one to one basis and a single service company offers a proprietary solution.

Current intelligent completion components are permanently installed downhole and as a consequence the reliability needs to be life of well. Requiring long term reliability in an additional cost and time barrier to developing new technology.

In an example currently available intelligent completion, the internal communications system functions entirely within the operator's firewall. The internal communications system will allow for communication between the control panel and the production control room, providing well specific data such as pressures, temperatures, flow rates and valve positions. The control panel is generally at the wellsite and is within the operator's internal communications and information technology systems. The main purpose of the control panel is to communicate at the surface with the downhole sensors and actuators, then be able to communicate that information within the operator's internal communications system.

In some currently available systems, the completion includes all of the hardware that interfaces between the reservoir and the surface production equipment such as, for example, surface valves, sub-surface safety valves, tubing hangers, production tubing, packers and casing. The valves can be hydraulic, all electric or a combination of electric and hydraulic. The valves and sensors can be positioned downhole, usually close to the flowing zones of the reservoir, but could be positioned anywhere on the completion. The sensors and actuators can include valves and data gathering devices to control flow to maximize production and improve the efficiency of the completion. The completion can also include umbilical or control lines that can run from the bottom of the completion to surface and provide electrical or hydraulic power and telemetry. The Umbilical and control lines can be mounted on the annulus of the tubing and can be used on their own or in a multiple flat packs.

SUMMARY OF THE DISCLOSURE

Embodiments of this disclosure provide systems and methods for providing more widely accessible intelligent completions by creating an architecture that enables access to communications and interchangeability and retrievability of sensors, actuators, and other downhole hardware. This will increase completion reliability and functionality and will decrease hardware costs and development time to entry and further integration. Systems and methods disclosed herein reduce the barriers to entry for new third party companies to develop intelligent completion components, allowing for many varied vendors to develop and access retrievable hardware, which will accelerate the development of completion equipment.

Embodiments disclosed herein provide an architecture to allow for remote access to certain data from the completion to be provided to anyone in the world with an internet connection and the correct operator approvals.

In an embodiment of this disclosure, a system for subterranean well developments includes a downhole assembly having well completion components for permanent installation within the subterranean well and interchangeable retrievable hardware. A connection system adapts the retrievable hardware to the well completion components, the connection system operable to provide a connection between the well completion components and the retrievable hardware. A telemetry system is in communication with the retrievable hardware and operable to access data from the downhole assembly. A remote access interface is in communication with the retrievable hardware.

In alternate embodiments, the data can include unrestricted data, relevant component data, and private data. The remote access interface can have a published architecture and be operable to access only the unrestricted data and the relevant component data from the downhole assembly. The well completion components can include an umbilical extendable within the subterranean well and in communication with a completion coupling of the connection system, the umbilical operable to provide communication between the completion coupling and both the telemetry system and the remote access interface. An internal communication system can include the telemetry system and a control panel located at an earth's surface and operable to access the unrestricted data, the relevant component data, and the private data from the downhole assembly. The retrievable hardware can include an installation profile shaped to engage a tool for installation and retrieval.

In other alternate embodiments, the connection system can have an adaptor with a standardized mating assembly and a connection to the retrievable hardware, and a hardware coupling oriented to connect to the well completion components. The connection system can be operable to provide a mechanical connection and signal communication between the well completion components and the retrievable hardware. The well completion components can include a side pocket mandrel and a completion coupling of the well completion components is located in the side pocket mandrel. The completion coupling can include an inductive coupler. The well completion components can include more than one side pocket mandrel and a completion coupling of the well completion components can be located in each of the side pocket mandrels. The retrievable hardware can be selected from a group consisting of sensors, meters, gauges, actuators, valves and combinations thereof. The system for subterranean well developments can be an intelligent completion system.

In another alternate embodiment of this disclosure, a system for subterranean well developments includes a downhole assembly having well completion components permanently installed within the subterranean well, including an umbilical extending into the subterranean well, and interchangeable retrievable hardware connected to the well completion components with a connection system. A telemetry system is in communication with the retrievable hardware, the telemetry system operable to access unrestricted data, relevant component data, and private data from the downhole assembly. The umbilical is connected to the connection system and provides communication between the retrievable hardware and the telemetry system. A remote access interface is in communication with the retrievable hardware by way of the telemetry system, the remote access interface having published architecture and operable to access the unrestricted data and the relevant component data from the downhole assembly.

In alternate embodiments, the intelligent completion system can include an adaptor, and the connection system can provide a mechanical connection and signal communication between the well completion components and the retrievable hardware, wherein the adaptor is connected to the retrievable hardware and has a standardized mating assembly for connecting to a hardware coupling and the hardware coupling has a proprietary coupling end for landing in the well completion components. An internal communication system can include the telemetry system and can have a closed architecture. The internal communication system can include a control panel located at an earth's surface and operable to locally access the unrestricted data, the relevant component data, and the private data from the downhole assembly and to control the retrievable hardware. The remote access interface can be operable to access the unrestricted data and the relevant component data remotely. The well completion components can include a side pocket mandrel and a completion coupling of the well completion components for communicating with the hardware coupling is located in the side pocket mandrel. The retrievable hardware can be selected from a group consisting of sensors, meters, gauges, actuators, valves and combinations thereof. The system for subterranean well developments can be an intelligent completion system In yet another alternate embodiment of this disclosure, a method of completing subterranean well developments includes providing a downhole assembly having well completion components for permanent installation within a subterranean well, and interchangeable retrievable hardware. The retrievable hardware is connected to the well completion components with a connection system. Data is accessed with a telemetry system in communication with the retrievable hardware. Data from the downhole assembly is accessed with a remote access interface in communication with the retrievable hardware.

In alternate embodiments, accessing the data can include accessing unrestricted data, relevant component data, and private data. The remote access interface can have a published architecture and accesses only the unrestricted data and the relevant component data from the downhole assembly. The connection system can have an adaptor with a standardized mating assembly connected to the retrievable hardware, and a hardware coupling oriented to connect to the well completion components, the connection system providing signal communication between the well completion components and the retrievable hardware. The method can further include retrieving and replacing the retrievable hardware with a downhole tool. The well completion components can include an umbilical extending within the subterranean well and in communication with the retrievable hardware. Accessing the unrestricted data, the relevant component data and the private data from the downhole assembly with the internal communication system can include accessing the unrestricted data, the relevant component data and the private data by way of the umbilical. Accessing only the unrestricted data and the relevant component data from the downhole assembly with the remote access interface can include accessing the unrestricted data and the relevant component data by way of the umbilical.

In other alternate embodiments, the method can further include controlling the retrievable hardware locally through a control panel located at an earth's surface and operable to access the unrestricted data, the relevant component data, and the private data from the downhole assembly. The well completion components can include a side pocket mandrel and the method can further include landing the retrievable hardware in the side pocket mandrel. The retrievable hardware can be selected from a group consisting of sensors, meters, gauges, actuators, valves and combinations thereof. The system can further include an internal communication system that can include the telemetry system and can have a closed architecture. Accessing only the unrestricted data and the relevant component data from the downhole assembly with the remote access interface can include accessing the unrestricted data and the relevant component data by way of the internal communication system. The method of completing subterranean well developments can be a method of intelligently completing subterranean well developments

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
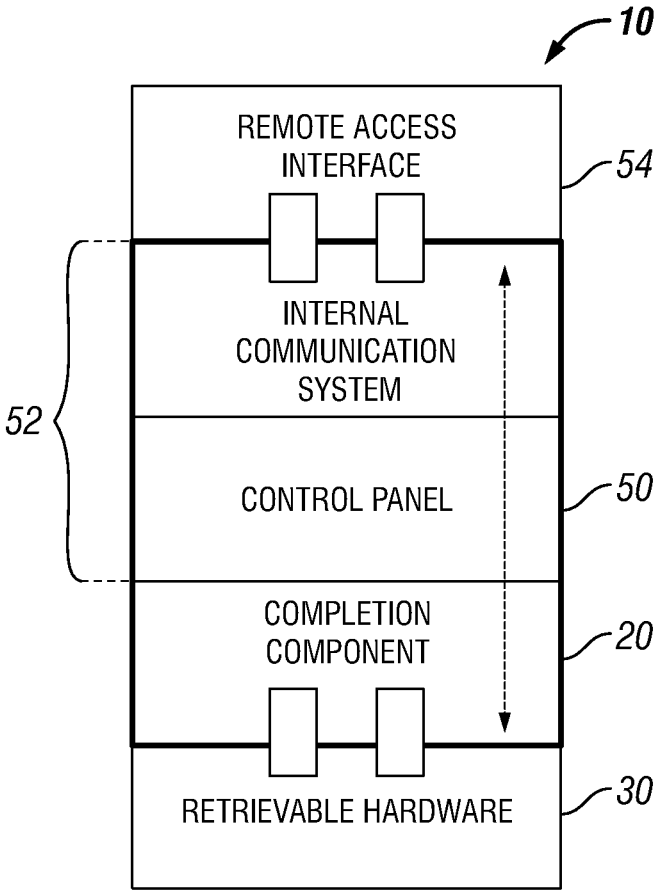
FIG. 1 is a schematic diagram of the interface between components of an intelligent completion system, in accordance with an embodiment of this disclosure.
Figure 4:
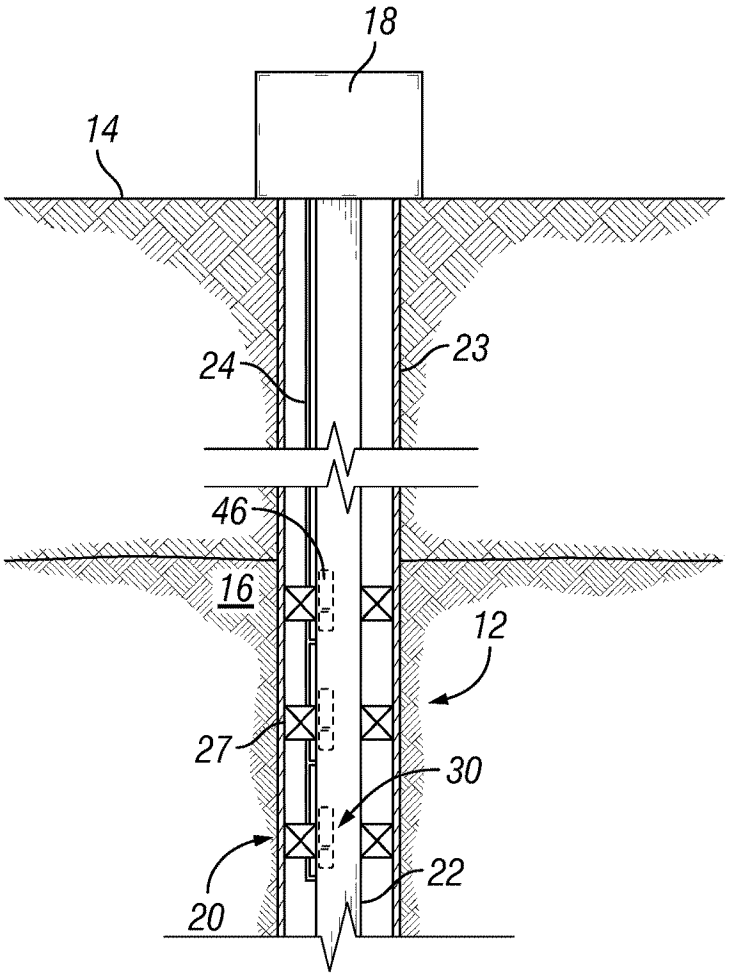
FIG. 4 is a schematic section view of a subterranean well having an intelligent completion system, in accordance with an embodiment of this disclosure.

Looking at FIGS. 1 and 4, an intelligent completion system 10 for subterranean well developments can include components that are located downhole in subterranean well 12 or at the earth's surface 14. In embodiments of this disclosure, intelligent completion system 10 includes a number of components that make up a backbone of the system. The backbone can include the equipment that is needed to provide production and well integrity from the reservoir 16 to the surface wellhead 18. The backbone can include well completion components 20 for permanent installation within subterranean well 12 and can also include surface components. Looking at FIGS. 4-6, as an example, well completion components 20 can include a completion tubular 22, casing 23, umbilical 24, a side pocket mandrel 26, packers 27, tubing hangers (not shown), cross-overs (not shown), screens (not shown), and other known downhole components that are permanent. The backbone includes components, such as well completion components 20, that have a high reliability and have a useful life that is the at least as long as the projected duration of well reliability. The elements of the backbone have a closed architecture so that the backbone is accessible only to the operator and has private proprietary mechanical and communications components.

As is further discussed in this disclosure, the backbone will have standardized power, telemetry and interface geometry, such as, for example at connection system 28. The backbone will include pre-engineered interfaces that allow retrievable hardware 30 to be positioned into, and retrieved from the backbone so that retrievable hardware 30 can have an open or published architecture. These interfaces will have standard geometry to allow third party vendors to design and develop new technology. This creates a universal backbone that allows for interchangeable retrievable hardware 30 to be remotely accessed and retrieved for maintenance and upgrades. In currently available systems, the introduction of new technology to intelligent completions, such as upgrades and repairs is slow and has a cautious culture due to the cost of failure and how those failures are repaired. The retrievability in interchangeability of retrievable hardware 30 reduces the development time because the consequence of failure is greatly reduced and thus life of well reliability is not needed for retrievable hardware 30, reducing the time consuming environmental testing of new products.

Retrievable hardware 30 can be electric and positioned downhole. In certain embodiments, retrievable hardware 30 is positioned close to the flowing zones of the reservoir and in alternate embodiments, retrievable hardware 30 could be positioned at any downhole. Retrievable hardware 30 can include data gathering devices to control flow, to maximize production, and improve the efficiency of the completion. Because of the interchangeability of retrievable hardware 30, retrievable hardware 30 can be retrieved as desired for maintenance or upgrades to new or improved technology.

Because retrievable hardware 30 is retrievable and interchangeable, retrievable hardware 30 can have a lower reliability. Retrievable hardware 30 can include, for example, one or more sensors, meters, gauges, actuators, valves and combinations of the same. In additional examples, retrievable hardware 30 can be flow meters, pressure gauges, temperature gauges, distributed temperature systems, fluid identification sensors, and any other control or controllable systems that can be manipulated by commands by way of umbilical 24. Both well completion components 20 and retrievable hardware 30 are part of a downhole assembly.

Figure 2:
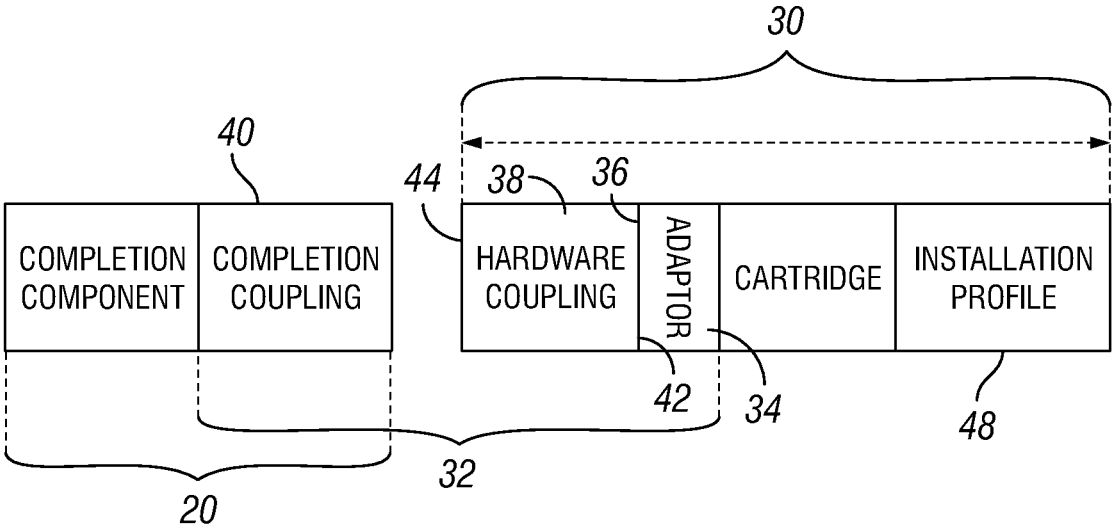
FIG. 2 is a schematic diagram of the interface between downhole components of an intelligent completion system, in accordance with an embodiment of this disclosure.
Figure 6:
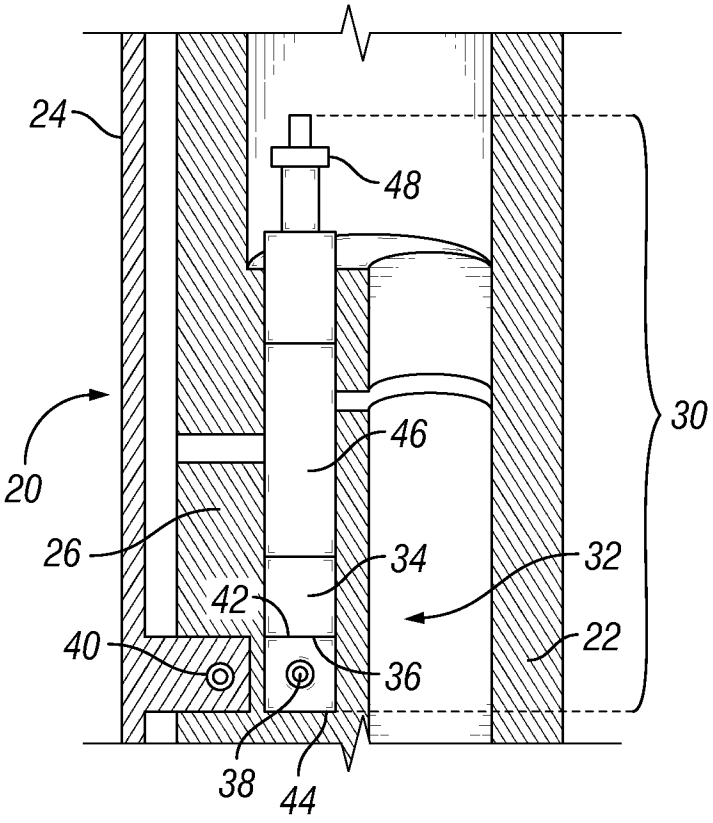
FIG. 6 is a detailed schematic section view of a portion of a subterranean well having an intelligent completion system, in accordance with an embodiment of this disclosure.

Looking at FIGS. 2 and 6, retrievable hardware 30 is not part of the backbone, and is connected to the backbone with connection system 32. Connection system 32 provides a mechanical connection and signal communication between well completion components 20 and retrievable hardware 30. Connection system 32 can include adaptor 34. Adaptor 34 can be standardized for connection to retrievable hardware 30. As an example, adaptor 34 can have a standardized mating assembly 36 for connecting to retrievable hardware 30. Vendors of retrievable hardware 30 can be provided with the specifications of standardized mating assembly 36 of adaptor 34 so that vendors can produce interchangeable retrievable hardware 30 that can be secured to adaptor 34 for connection to well completion components 20. Adaptor 34 can be a separate component from connection system 32. In alternate embodiments, adaptor 34 can be integrally formed with well completion component 20 so that standardized mating assembly 36 is integrated with retrievable hardware 30.

Adaptor 34 can act as a cross-over that mechanically and electrically converts the connector of retrievable hardware 30 to the connector used by hardware coupling 38 of connection system 32. Hardware coupling 38 has a standardized mating end 42 for connection with standardized mating assembly 36 of adaptor 34. Hardware coupling 38 has a proprietary coupling end 44 for landing within well completion component 20. Hardware coupling 38 also provides a signal communication connection with completion coupling 40.

In the example embodiment of FIG. 6, retrievable hardware 30 includes a cartridge 46. Cartridge 46 can contain meters, sensors, valves, actuators, or other control or controllable systems that can be monitored or manipulated by commands by way of umbilical 24. Cartridge 46 has installation profile 48 that is shaped to engage a downhole tool for the installation, retrieval, and replacement of retrievable hardware 30. Installation profile 48 can also include a mechanical locking mechanism for locking retrievable hardware 30 to well completion components 20.

Figure 5:
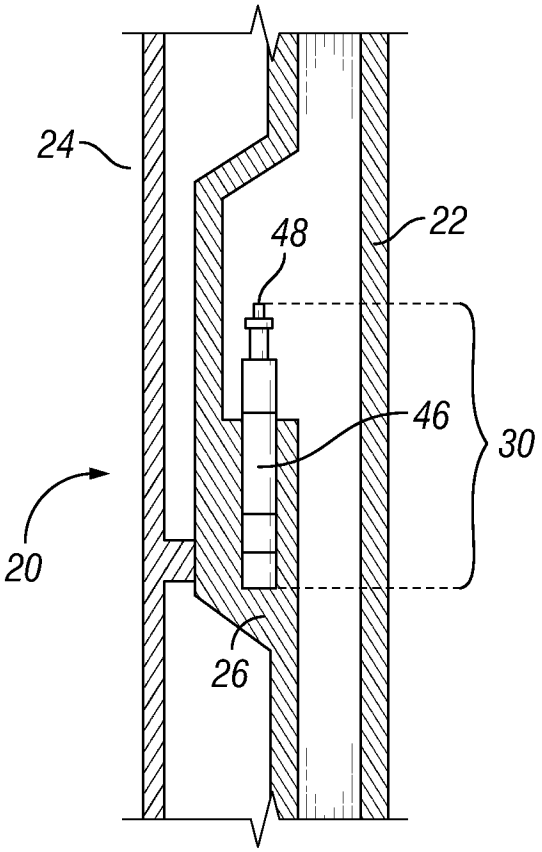
FIG. 5 is a detailed schematic section view of a portion of a subterranean well having an intelligent completion system, in accordance with an embodiment of this disclosure.

In the example embodiment of FIGS. 5-6, well completion components 20 include side pocket mandrel 26 and retrievable hardware 30 is landed within side pocket mandrel 26. Completion coupling 40 is also a well completion component 20 and is located within or a part of side pocket mandrel 26. When cartridge 46 is landed within side pocket mandrel 26, proprietary coupling end 44 can land within well completion component 20. When cartridge 46 is landed within side pocket mandrel 26, completion coupling 40 can provide signal communication with hardware coupling 38 so that information from retrievable hardware 30 can reach umbilical 24. Umbilical 24 is in communication with completion coupling 40. In the example of FIG. 6, umbilical 24 is attached directly to completion coupling 40. Umbilical 24 can provide both electrical power and operational communications to retrievable hardware 30.

Completion coupling 40 can be in direct mechanical contact with hardware coupling 38 or indirect mechanical contact with hardware coupling 38. Completion coupling 40 and hardware coupling 38 can utilize an inductive coupler, other form of magnetic coupler, a direct physical connection, or other coupling system that allows for signal communication between completion coupling 40 and hardware coupling 38.

Figure 3:
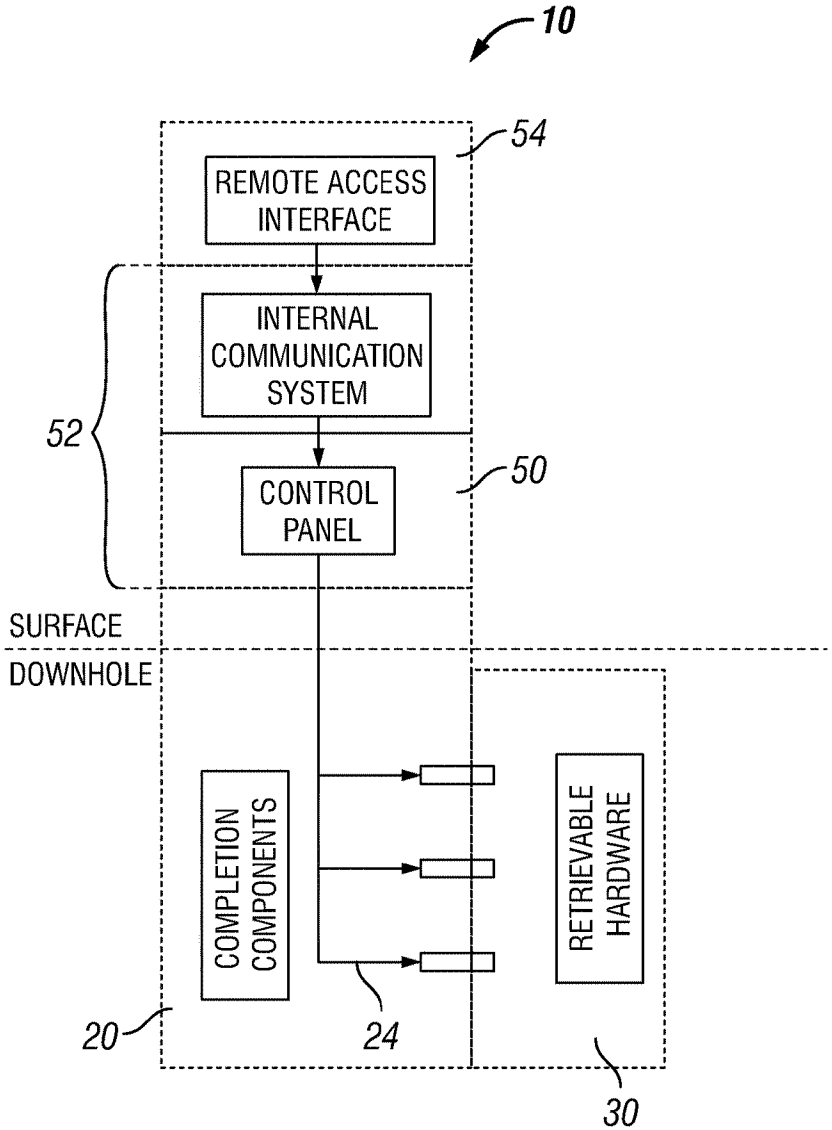
FIG. 3 is a schematic diagram of the interface between surface and downhole components of an intelligent completion system, in accordance with an embodiment of this disclosure.

Looking at FIGS. 1 and 3, surface parts of the backbone can include control panel 50. Control panel 50 can be located at earth's surface 14 (FIG. 4) and can access data gathered by the downhole assembly, including from retrievable hardware 30. Control panel 50 is part of private internal communication system 52. Control panel 50 is electrically connected to retrievable hardware 30 by way of umbilical 24. Umbilical 24 is mechanically connected between connection system 32 and internal communication system 52 and provides for local wired communication between retrievable hardware 30 and internal communication system 52.

Internal communication system 52, including control panel 50 has a closed architecture so that the data accessed by control panel 50 and the communications between retrievable hardware 30 and control panel 50 are local, private, and maintained behind an operator firewall. Internal communication system 52 can include a telemetry system and be maintained in accordance with the operators information technology systems and policies In an example internal communication system 52, the software used for data storage can be The Plant Information from OSI Software, Inc., or other similar or suitable software. A remote terminal unit (RTU) can be located at a well shed within about one kilometer from surface wellhead 18. The RTU can be of a type from Invensys (now Schneider Electric) or other industry provider. An umbilical can be run from downhole through surface wellhead 18 and in a surface conduit to a proprietary vendor surface control unit (SCU). The output from the SCU is a standardized well information format using an ethernet connection. The RTU receives the SCU data via ethernet and transmits that data by way of a fiber optic ethernet to the Gas and Oil Separation Plant (GOSP). A control room at the GOSP can be used for controlling the entire field. Well downhole data and actuations can be monitored and controlled from the either the GOSP, SCU, or at the wellhead. As described herein, in embodiments of this disclosure a separate secure connection can be provided with limited access via internet to appropriate components in the well.

The data from retrievable hardware 30 and other downhole components can include both accessible data and private data. As an example, the data can include gauge and meter readings, well data, and equipment status information. Private data is data that is unavailable outside of internal communication system 52. The private data can include well number, lateral, compartment wellhead pressure, downhole pressure, temperatures, flow rates, water cut, gas rate, oil rate, choke position, and other well relevant component data. Accessible data is data that is accessible outside of internal communication system 52. Accessible data can include both unrestricted data and certain relevant component data. Unrestricted data is data that is generally accessible and available to third parties, such as component health check information including voltage, current, communications errors, motor RPM, linear actuator position, and other non-well data. In embodiments of this disclosure, relevant component data includes limited well data that is in some way associated with a single or group of downhole components and is specifically relevant to such specific components. The relevant component data may not include all of the well data or even all of the component data, but will include only the data which is pre-arranged as relevant to the quality control and performance monitoring of the specific identified component. All of the accessible data is provided as information only and no component control or other control is given in connection with the access granted to the accessible data.

Control panel 50 can also be used to control retrievable hardware 30 locally. For example, if retrievable hardware 30 includes valves or actuators, control panel 50 can be used to move such valves or actuators between open and closed positions.

In order to allow for access by third parties to certain data from retrievable hardware 30, intelligent completion system 10 can include accessible remote access interface 54. Remote access interface 54 is in communication with retrievable hardware 30 by way of internal communication system 52 and umbilical 24. Umbilical 24 can therefore provide communication between completion coupling 40 and both internal communication system 52 and remote access interface 54. Remote access interface 54 has a published architecture and allows access to only the accessible data from the downhole assembly.

Remote access interface 54 can allow an authorized user to access the data from a remote location. Remote access interface 54 can include hardware and software that can interface with accessible data from retrievable hardware 30 and other downhole equipment. Remote access interface 54 can include, for example, a computer and related software located anywhere in the world for accessing information from retrievable hardware 30 and other downhole equipment.

Remote access interface 54 will not provide control of retrievable hardware 30, but will provide for external monitoring. In this way the operator retains full control of operations of intelligent completion system 10 and the development of subterranean well 12 while providing certain accessible data to third parties. As an example, a component developer can be provided access to relevant component data that is relevant to his developed component so that the developer can evaluate the performance of the component, can troubleshoot problems of such component while the component is in service, and utilize the provided relevant component data to improve future versions of such component. This is a significant advantage over current systems where component developers have restricted or no access to information relating to the developed components once the developed components are commissioned. In embodiments of the current application, developers maintain access to relevant component data relating to the developed component after commissioning during the useful lifetime of the component.

In an example of operation, subterranean well 12 can be completed in the usual manner with well completion components 20 for permanent installation within subterranean well 12, which are proprietary and have a closed architecture. Retrievable hardware 30 can be included in the completion and secured to well completion components 20 with connection system 32. Retrievable hardware 30 can be in signal communication with umbilical 24 through completion coupling 32. Umbilical 24 can provide accessible and private data from retrievable hardware 30 to both internal communication system 52 with a closed architecture and can provide only accessible data from retrievable hardware 30 to remote access interface 54 that has an open or published interface.

If retrievable hardware 30 fails or maintenance or updates to retrievable hardware 30 is desired, retrievable hardware 30 is retrievable, replaceable, and interchangeable with technology that can be developed by multiple suppliers. If new or improved data assessment technology is desired, remote access interface 54 can provide access to multiple parties for providing data from retrievable data for the development and application of hardware and software to be used in conjunction with remote access interface 54.

Therefore embodiments of this disclosure provide with open or published architecture interfaces that have been standardized to empower multiple developers to deliver lower cost and higher functionality systems, with shorter lead times. New retrievable hardware 30 can then be designed without the life of well reliability testing and qualification, thus reducing the barriers for the development of intelligent completion components. Component failure does not cause system failure. The retrievability of retrievable hardware 30 creates a field testing environment for the new product development process. This product testing experience will accelerate the product development cycle and a reduction in the overall product development time.

In example embodiments, an intelligent completion that includes multi-zone wells can be configured so that simple parts are permanent and complex parts are economically retrievable. The standardization of retrievable hardware 30 will allow multiple developers to deliver lower cost higher functionality systems, with shorter lead times.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A system for subterranean well developments, the system including:

a downhole assembly having:

well completion components for permanent installation within the subterranean well;

interchangeable retrievable hardware; and a connection system adapting the retrievable hardware to the well completion components, the connection system operable to provide a connection between the well completion components and the retrievable hardware;

a local and private internal communication system in communication with the retrievable hardware and operable to access data from the downhole assembly, where the data includes unrestricted data, relevant component data, and private data;

an umbilical extending between the local and private internal communication system at the earth's surface and the downhole assembly, the umbilical operable to provide power to the downhole assembly and to deliver the unrestricted data, the relevant component data, and the private data to the local and private internal communication system at the earth's surface; and a remote access interface in communication with the retrievable hardware, where the remote access interface has a published architecture, is operable to access only the unrestricted data and the relevant component data from the downhole assembly, and is accessible from a location that is mechanically separate from the local and private internal communication system.

2. The system of claim 1, where the internal communication system includes a telemetry system and a control panel located at an earth's surface and is operable to access the unrestricted data, the relevant component data, and the private data from the downhole assembly.

3. The system of claim 1, wherein the retrievable hardware includes an installation profile shaped to engage a tool for installation and retrieval.

4. The system of claim 1, wherein the connection system has a standardized mating assembly and a connection to the retrievable hardware, and a hardware coupling oriented to connect to the well completion components, the connection system operable to provide a mechanical connection and signal communication between the well completion components and the retrievable hardware.

5. The system of claim 1, wherein the well completion components includes a side pocket mandrel and a completion coupling of the well completion components is located in the side pocket mandrel.

6. The system of claim 5, wherein the completion coupling includes an inductive coupler.

7. The system of claim 1, wherein the well completion components includes more than one side pocket mandrel and a completion coupling of the well completion components is located in each of the side pocket mandrels.

8. The system of claim 1, wherein the retrievable hardware is selected from a group consisting of sensors, meters, gauges, actuators, valves and combinations thereof.

9. The system of claim 1, wherein the system for the subterranean well developments is an intelligent completion system.

10. A system for subterranean well developments, the system including:

a downhole assembly having:

well completion components permanently installed within the subterranean well, including an umbilical extending into the subterranean well; and interchangeable retrievable hardware connected to the well completion components with a connection system;

a local and private internal communication system located at an earth's surface and having a closed architecture and in communication with the retrievable hardware by way of a an umbilical, the umbilical operable to access unrestricted data, relevant component data, and private data from the downhole assembly, wherein the umbilical is connected to the connection system and provides communication between the retrievable hardware and the internal communication system, and provides power to the downhole assembly; and a remote access interface in communication with the retrievable hardware by way of a telemetry system, the remote access interface having published architecture, operable to access only the unrestricted data and the relevant component data from the downhole assembly, and operable to provide only the unrestricted data and the relevant component data to a location that is mechanically separate from the local and private internal communication system.

11. The system of claim 10 wherein the connection system provides a mechanical connection and signal communication between the well completion components and the retrievable hardware, and wherein the retrievable hardware has a standardized mating assembly for connecting to a hardware coupling and the hardware coupling has a proprietary coupling end for landing in the well completion components.

12. The system of claim 11, wherein the well completion components includes a side pocket mandrel and a completion coupling of the well completion components for communicating with the hardware coupling is located in the side pocket mandrel.

13. The system of claim 10, wherein the internal communication system includes a control panel located at an earth's surface and operable to locally access the unrestricted data, the relevant component data, and the private data from the downhole assembly and to control the retrievable hardware.

14. The system of claim 10, wherein the remote access interface is operable to access the unrestricted data and the relevant component data remotely.

15. The system of claim 10, wherein the retrievable hardware is selected from a group consisting of sensors, meters, gauges, actuators, valves and combinations thereof.

16. The system of claim 10, wherein the system for the subterranean well developments is an intelligent completion system.

17. A method of completing subterranean well developments, the system including:

providing a downhole assembly having well completion components for permanent installation within the subterranean well, and interchangeable retrievable hardware;

connecting the retrievable hardware to the well completion components with a connection system;

providing power to the downhole assembly with an umbilical;

accessing data from the downhole assembly with a local and private internal communication system located at an earth's surface and in communication with the retrievable hardware by way of the umbilical, the internal communication system having a closed architecture and where the data includes unrestricted data, relevant component data, and private data; and accessing the data from the downhole assembly from a location that is mechanically separate from the local and private internal communication system with a remote access interface in communication with the retrievable hardware, the remote access interface having a published architecture and accessing only the unrestricted data and the relevant component data from the downhole assembly.

18. The method of claim 17, further including controlling the retrievable hardware locally through a control panel of the internal communication system located at an earth's surface and operable to access the unrestricted data, the relevant component data and the private data from the downhole assembly.

19. The method of claim 17, wherein the connection system has a standardized mating assembly connected to the retrievable hardware, and a hardware coupling oriented to connect to the well completion components, the connection system providing signal communication between the well completion components and the retrievable hardware.

20. The method of claim 17, further including retrieving and replacing the retrievable hardware with a downhole tool.

21. The method of claim 17, wherein the well completion components includes a side pocket mandrel and the method further includes landing the retrievable hardware in the side pocket mandrel.

22. The method of claim 17, wherein the retrievable hardware is selected from a group consisting of sensors, meters, gauges, actuators, valves and combinations thereof.

23. The method of claim 17, wherein the method of completing subterranean well developments is a method of intelligently completing subterranean well developments.

* * * * *